US008277083B2

(12) United States Patent
Kuromizu

(10) Patent No.: US 8,277,083 B2
(45) Date of Patent: Oct. 2, 2012

(54) DISCHARGE TUBE, LIGHTING DEVICE, DISPLAY DEVICE AND TELEVISION RECEIVER

(75) Inventor: Yasumori Kuromizu, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 386 days.

(21) Appl. No.: 12/742,970

(22) PCT Filed: Jul. 25, 2008

(86) PCT No.: PCT/JP2008/063379
§ 371 (c)(1),
(2), (4) Date: May 14, 2010

(87) PCT Pub. No.: WO2009/081609
PCT Pub. Date: Jul. 2, 2009

(65) Prior Publication Data

US 2010/0259695 A1 Oct. 14, 2010

(30) Foreign Application Priority Data

Dec. 20, 2007 (JP) ..... 2007-328978

(51) Int. Cl.
*F21V 33/00* (2006.01)

(52) U.S. Cl. ..... 362/263; 362/217.13; 362/217.17

(58) Field of Classification Search ..... 362/97.1, 362/97.2, 217.08, 217.09, 217.13, 217.14, 362/217.17, 260, 263; 439/226, 612, 890
See application file for complete search history.

(56) References Cited

U.S. PATENT DOCUMENTS

| | | | |
|---|---|---|---|
| 2003/0112626 | A1 | 6/2003 | Yoo et al. |
| 2005/0231979 | A1 | 10/2005 | Yoo et al. |
| 2010/0007820 | A1 | 1/2010 | Yoo et al. |

FOREIGN PATENT DOCUMENTS

| | | | |
|---|---|---|---|
| CN | 1575505 | A | 2/2005 |
| CN | 101030688 | A | 9/2007 |
| JP | 05-090836 | U | 12/1993 |
| JP | 08-032322 | A | 2/1996 |
| JP | 2006-093011 | A | 4/2006 |
| JP | 2007-234551 | A | 9/2007 |

OTHER PUBLICATIONS

Official Communication issued in International Patent Application No. PCT/JP2008/063379, mailed on Sep. 16, 2008.

*Primary Examiner* — Laura Tso
(74) *Attorney, Agent, or Firm* — Keating & Bennett, LLP

(57) ABSTRACT

A discharge tube 17 of the present invention includes a glass tube 60 and ferrules 70 disposed around ends of the glass tube 60. Outer leads 61 for receiving power from an external power source project from ends of the glass tube 60. Each ferrule 70 includes a body 71 that is fitted onto the glass tube 60 and an insertion portion 73 that is disposed near the end of the body 71 and into which the outer lead 61 is inserted. The outer lead 61 includes a loop portion 62 at the end thereof. The outer lead 61 is electrically connected with the ferrule 70 when the loop portion 62 is inserted in the insertion portion 73.

14 Claims, 15 Drawing Sheets

DISCHARGE TUBE, LIGHTING DEVICE, DISPLAY DEVICE AND TELEVISION RECEIVER

TECHNICAL FIELD

The present invention relates to a discharge tube, a lighting device, a display device and a television receiver.

BACKGROUND ART

In a display device using non-light emitting optical components, such as a liquid crystal display device, a backlight device is provided behind a display panel such as a liquid crystal display panel for illuminating the display panel. The backlight device generally includes a plurality of fluorescent tubes (e.g., cold cathode tubes) as light sources. To supply currents to the fluorescent tubes, they need to be connected to electrical lines. However, high precision work is required for the connection and the work is time consuming. A configuration of a fluorescent tube disclosed in Patent Document 1 is known as one that aims to improve work efficiency.

The fluorescent tube disclosed in Patent Document 1 includes a lead line extending from an end of the fluorescent tube and a connecting part for making connection with an electrical wire to supply power to the fluorescent tube. The connecting part includes a conductive base sheet and a through hole. One of ends of the base sheet is configured as a first holding portion for holding the electrical wire. The first holing portion is inserted from one of openings of the through hole. The other end of the base sheet is configured as a second holding portion for holding the lead line of the fluorescent tube. The second holding portion is inserted from the other opening of the through hole.

Patent Document 1: Japanese Published Patent Application No. 2006-93011

(Problem to be Solved by the Invention)

During assembly of the fluorescent tube, the lead line (hereinafter referred to as an outer lead) that extends from the end of the fluorescent tube is inserted in the holding portion of the connecting part (hereinafter referred to as a ferrule). The outer lead is a wire that is widely known as a Dumet wire prepared by wrapping a copper layer around a nickel-iron alloy core wire. Ferrules, sizes of fluorescent tubes and assembly machines may vary from one another, respectively. Therefore, when the outer lead is inserted in the holding portion of the ferrule, a tip of the outer lead may hit the edge of the holding portion and not enter into the through hole of the holding portion. Because the outer lead is in a wire shape, it does not have much tolerance to a bending force caused when the tip hits the edge of the holding portion and thus may be deformed.

To reduce occurrence of such a deformation, a diameter of the outer lead may be increased in size to increase the physical strength thereof. However, a larger diameter of the outer lead may increase a level of displacement between the outer lead and a glass tube that is a main body of the fluorescent tube due to a difference in thermal expansion rates thereof. This may damage the glass tube.

Alternatively, a diameter of an insertion hole of the holding portion may be increased so that the outer lead is easily inserted. This may reduce the occurrence of deformation of the outer lead. However, a large gap is present between the outer lead and the inner surface of the holding portion when the outer lead is inserted in the holding portion. As a result, the outer lead cannot be properly held.

DISCLOSURE OF THE PRESENT INVENTION

The present invention was made in view of the foregoing circumstances. An object of the present invention is to provide a discharge tube in which connection between an outer lead and a ferrule can be easily and properly made with a simple configuration. Another object of the present invention is to provide highly reliable lighting device, display device and television receiver manufactured at high yield rate that can be achieved by including such a discharge tube.

(Means for Solving the Problem)

To solve the above problem, a discharge tube of the present invention includes a glass tube and a ferrule disposed around an end area of said glass tube. The glass tube includes an outer lead projecting from an end thereof and configured to receive power from an external power supply. The ferrule includes a body configured to be fitted onto the glass tube and an insertion portion into which the outer lead is inserted. The outer lead includes a turn portion at a tip thereof and is electrically connected to the ferrule through the turn portion inserted in the insertion portion.

By preparing the turn portion at the tip of the outer lead, the apparent width of the tip becomes larger in comparison to a straight tip and thus the apparent strength of the tip is enhanced. With this structure, even when the tip of the outer lead hits the edge of the insertion portion, the outer lead is tolerant to a bending force caused when the tip hits the edge of the holding portion. Therefore, unexpected deformation or damage can be reduced. As a result, the outer lead is properly connected to the ferrule having the insertion portion without decreasing the yield rate.

Figure 2:
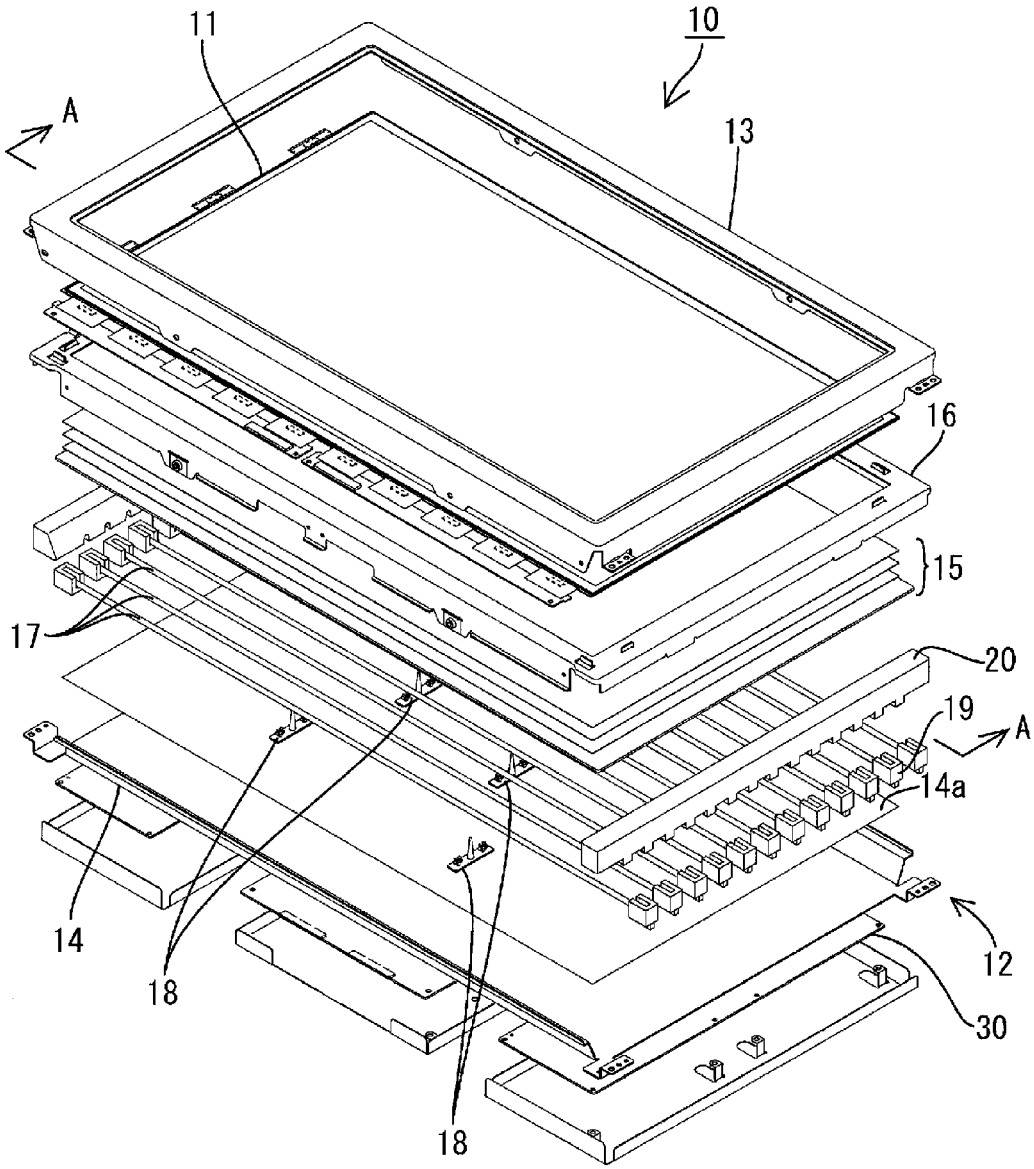
Figure 3:
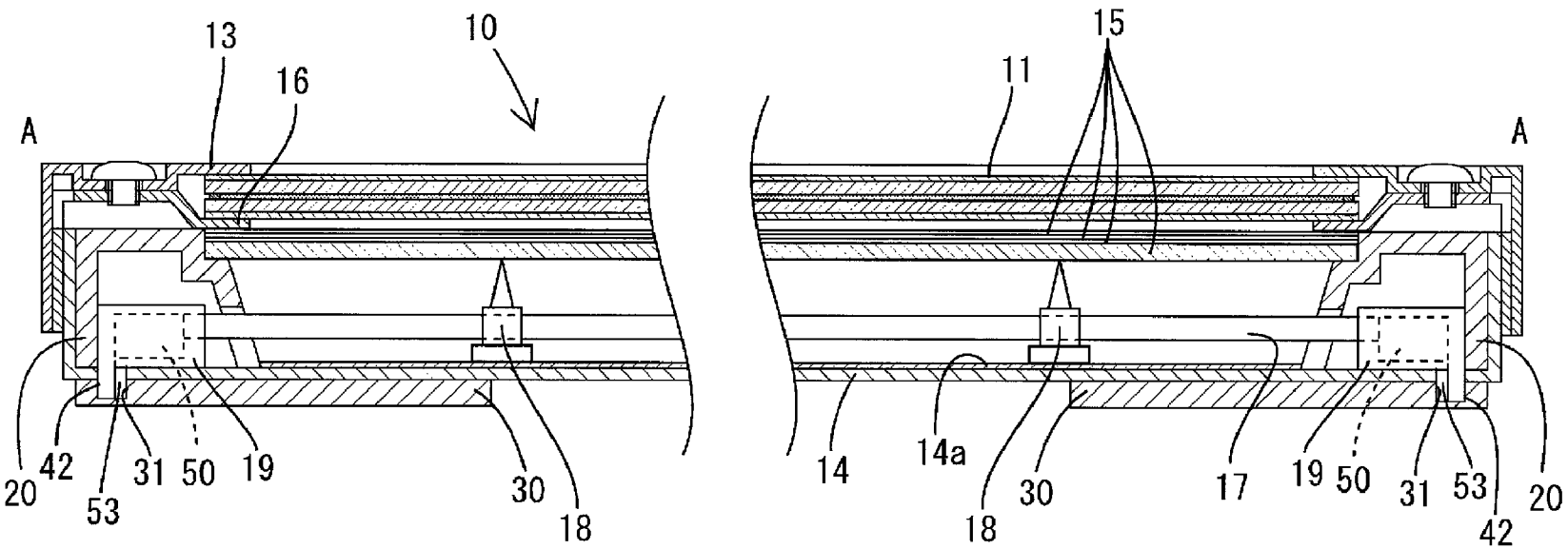
Figure 4:
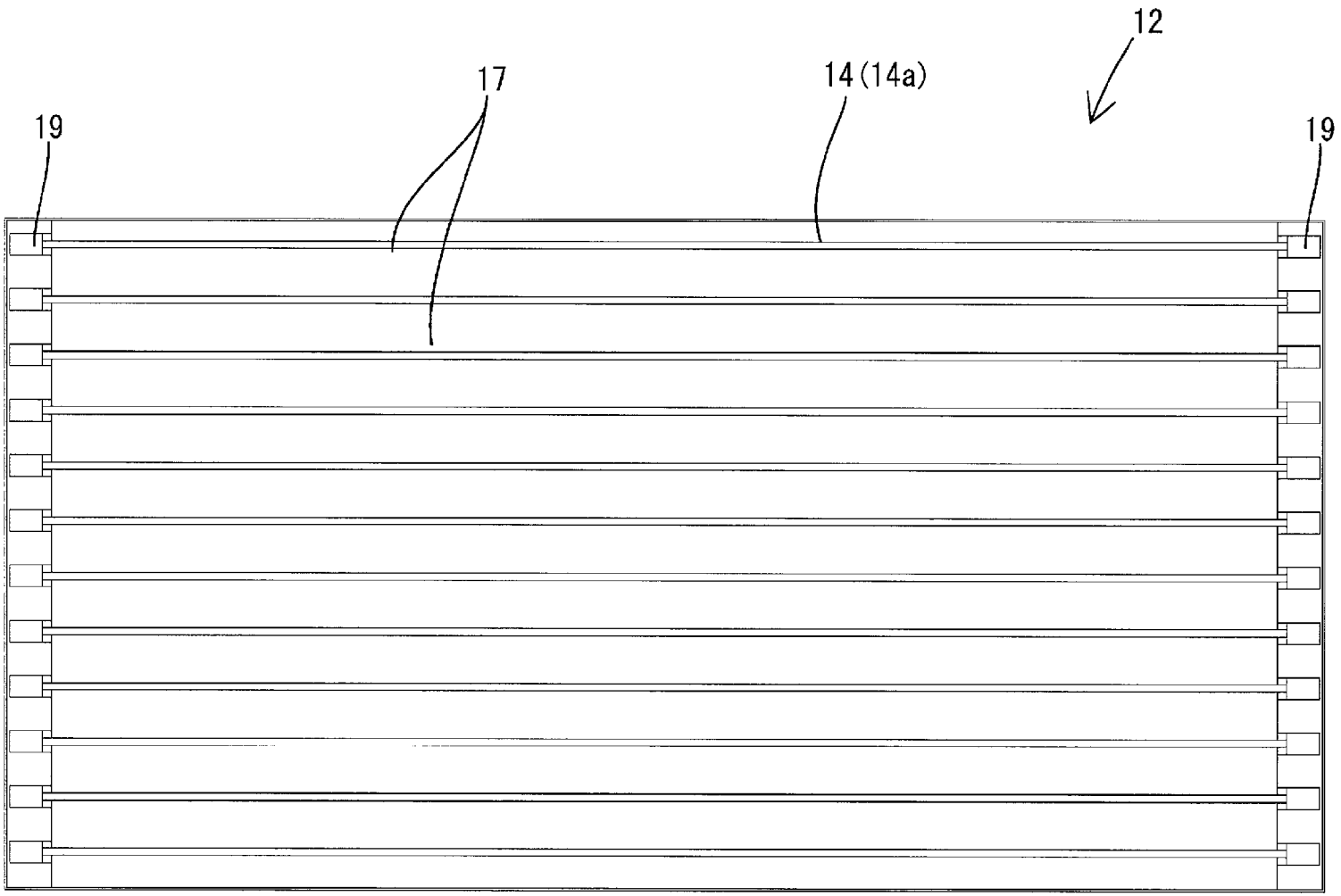
Figure 5:
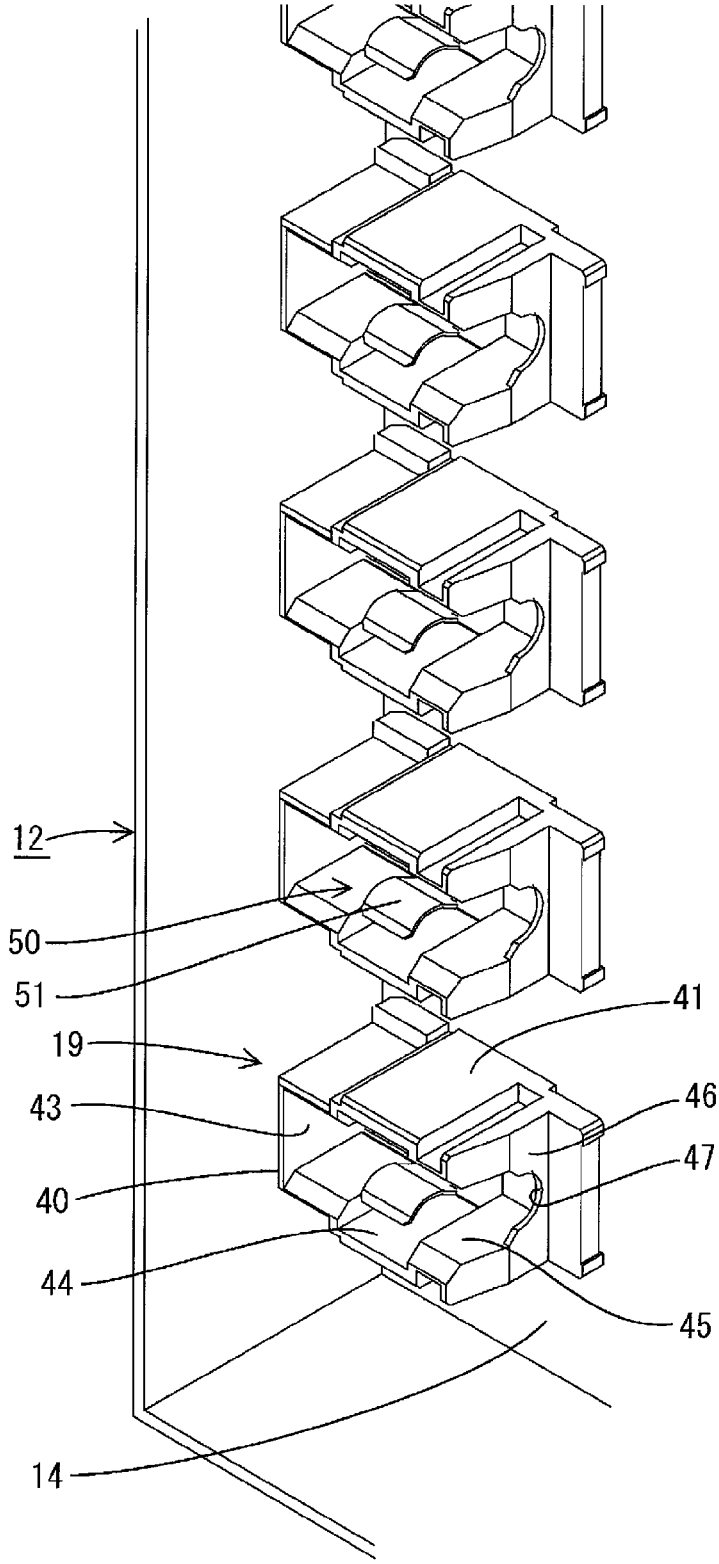
Figure 6:
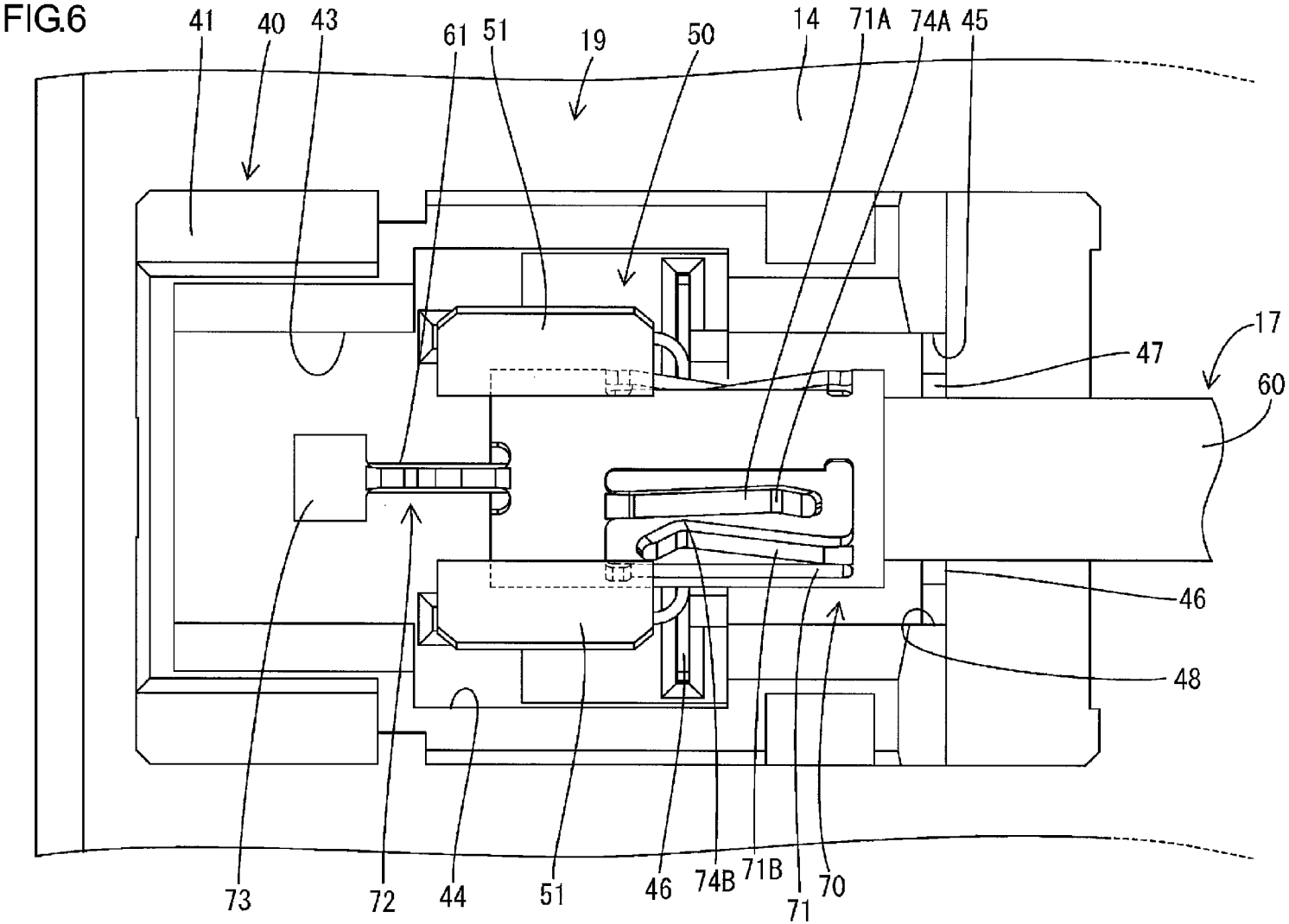
Figure 7:
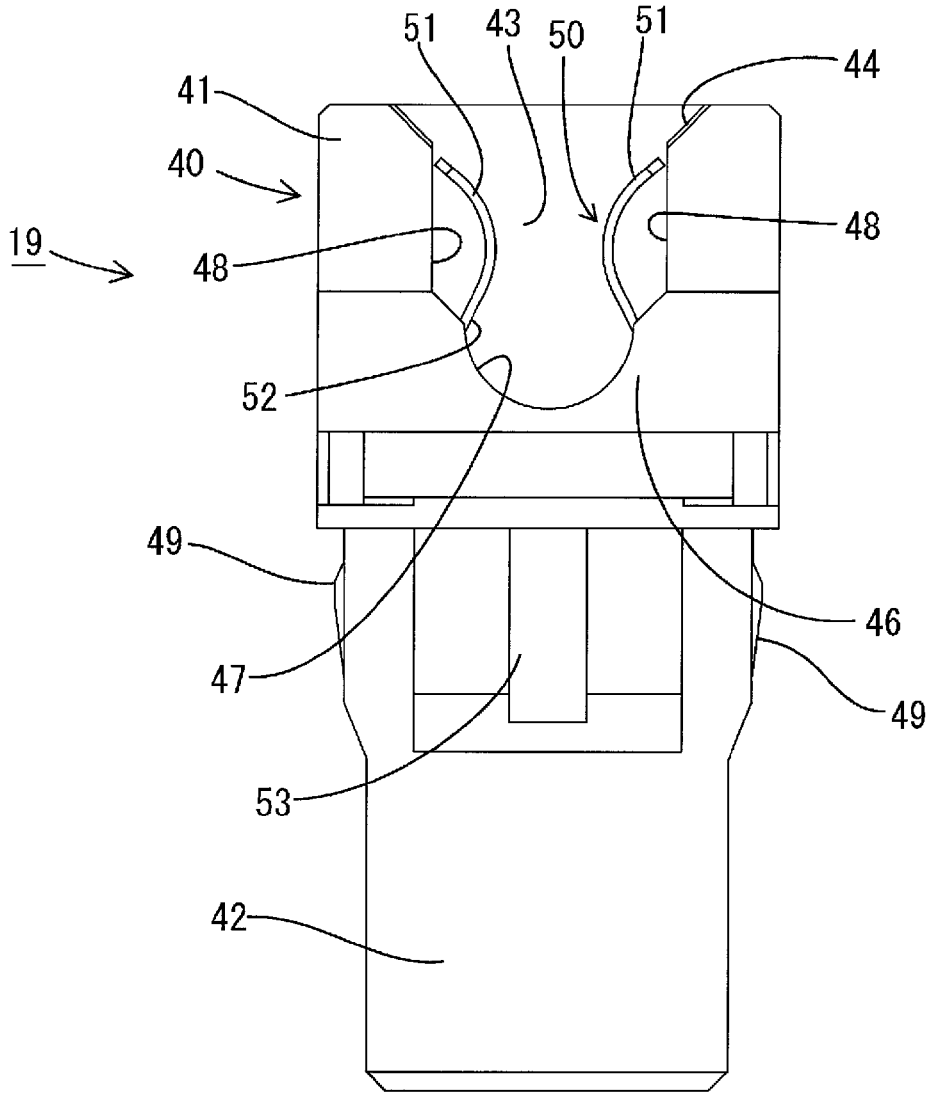
Figure 8:
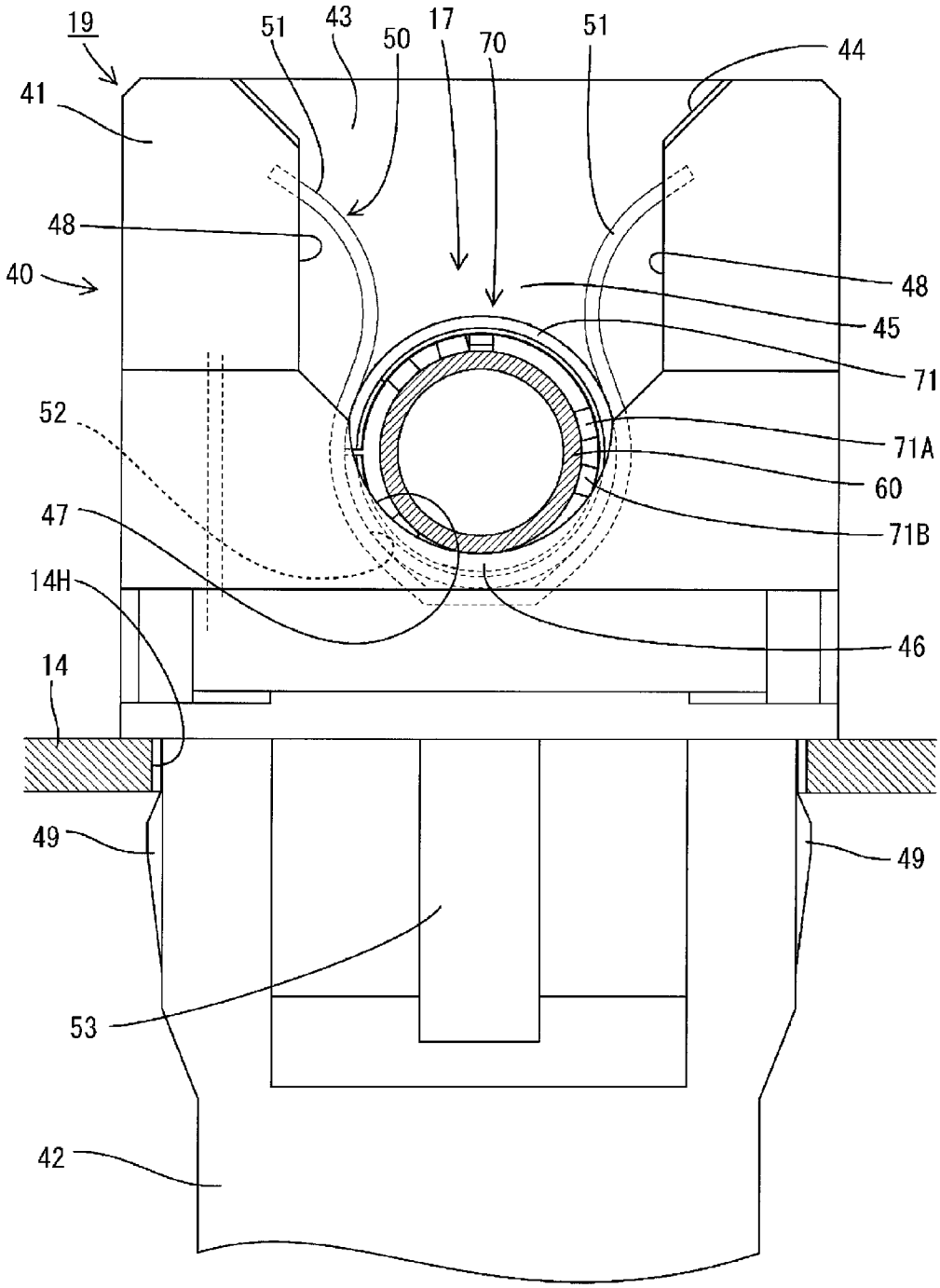
Figure 9:
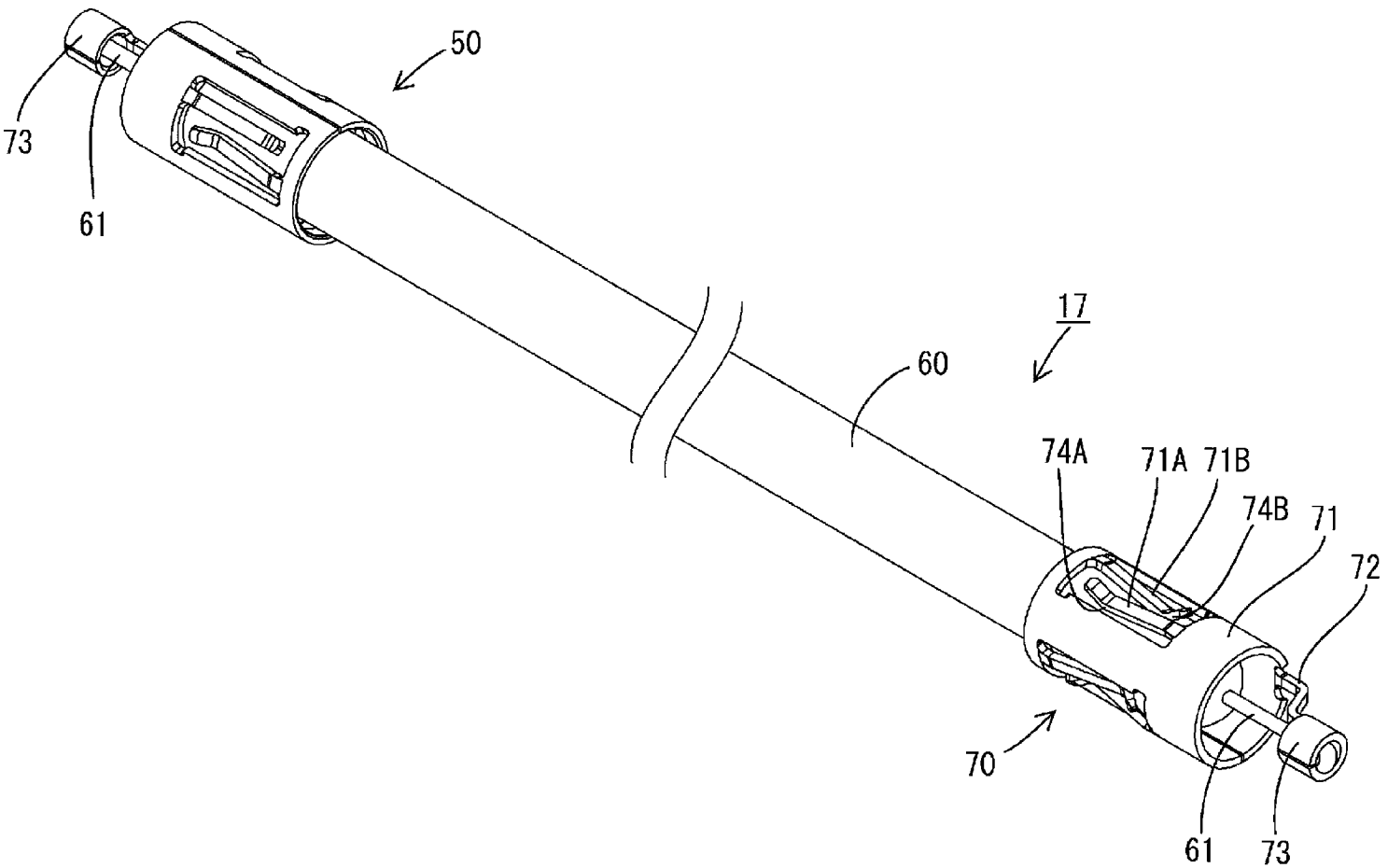
Figure 10:
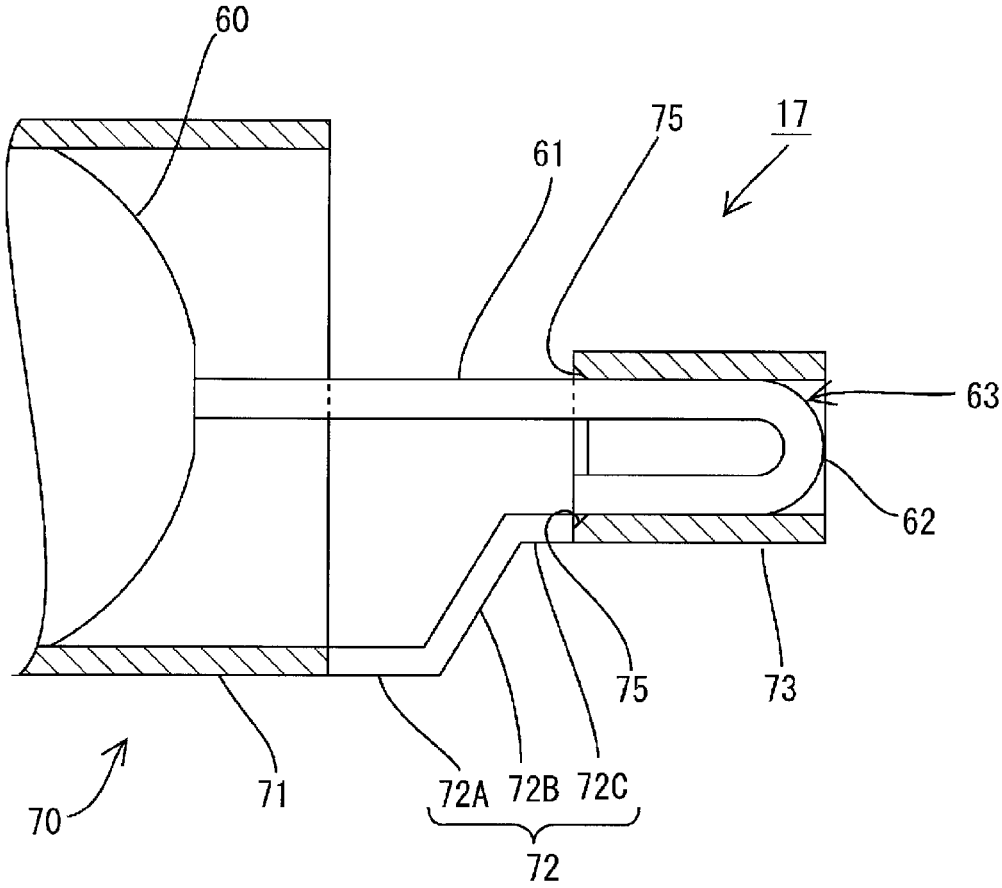
Figure 11:
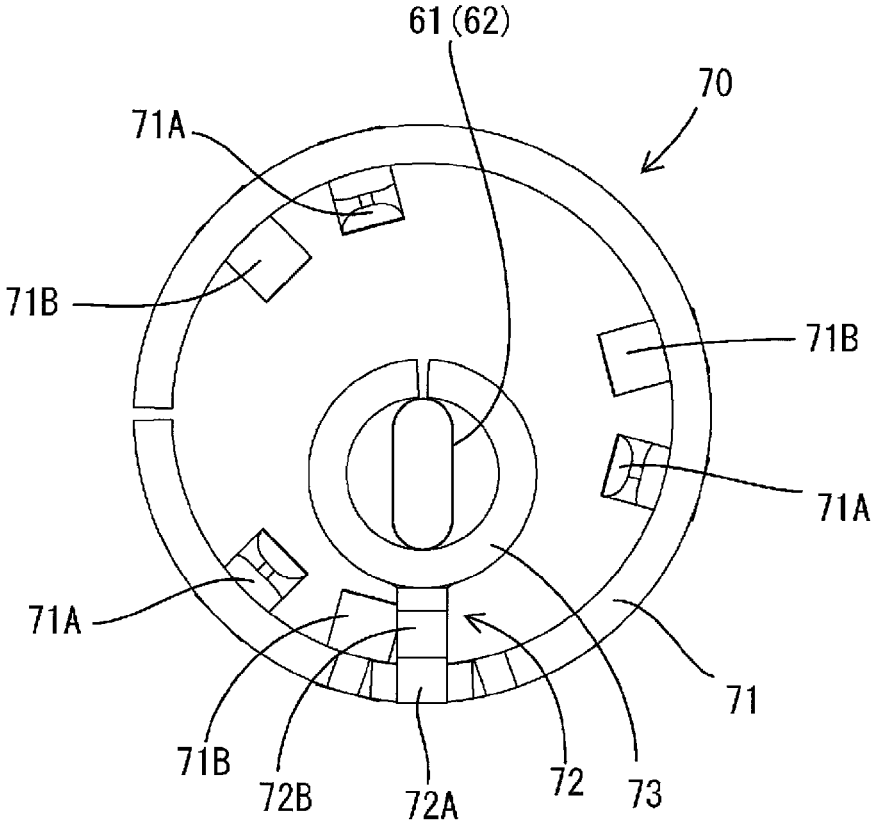
Figure 12:
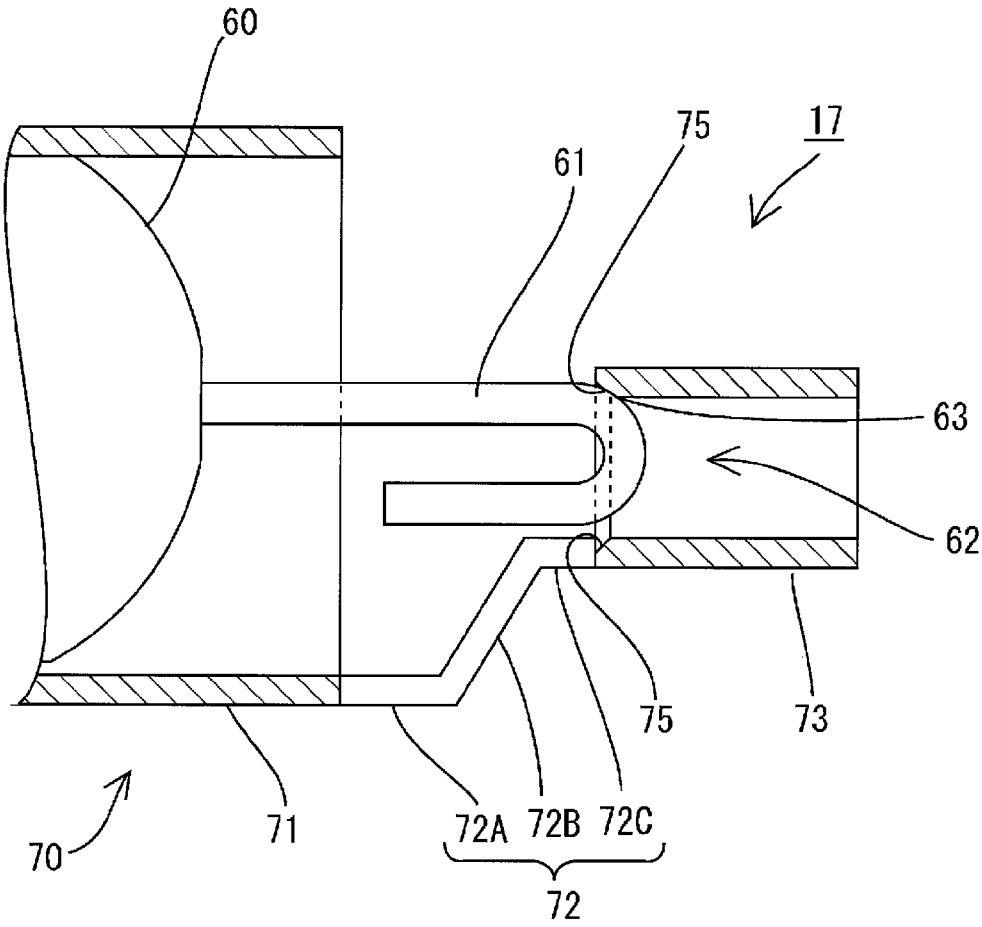
Figure 13:
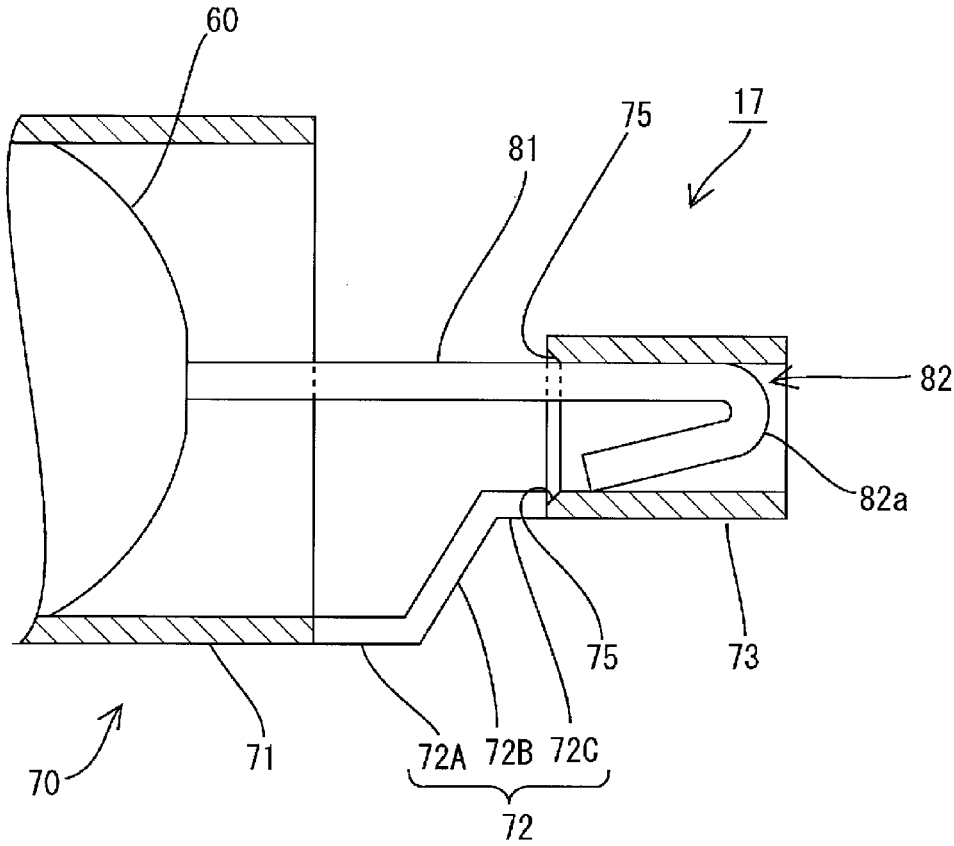
Figure 14:
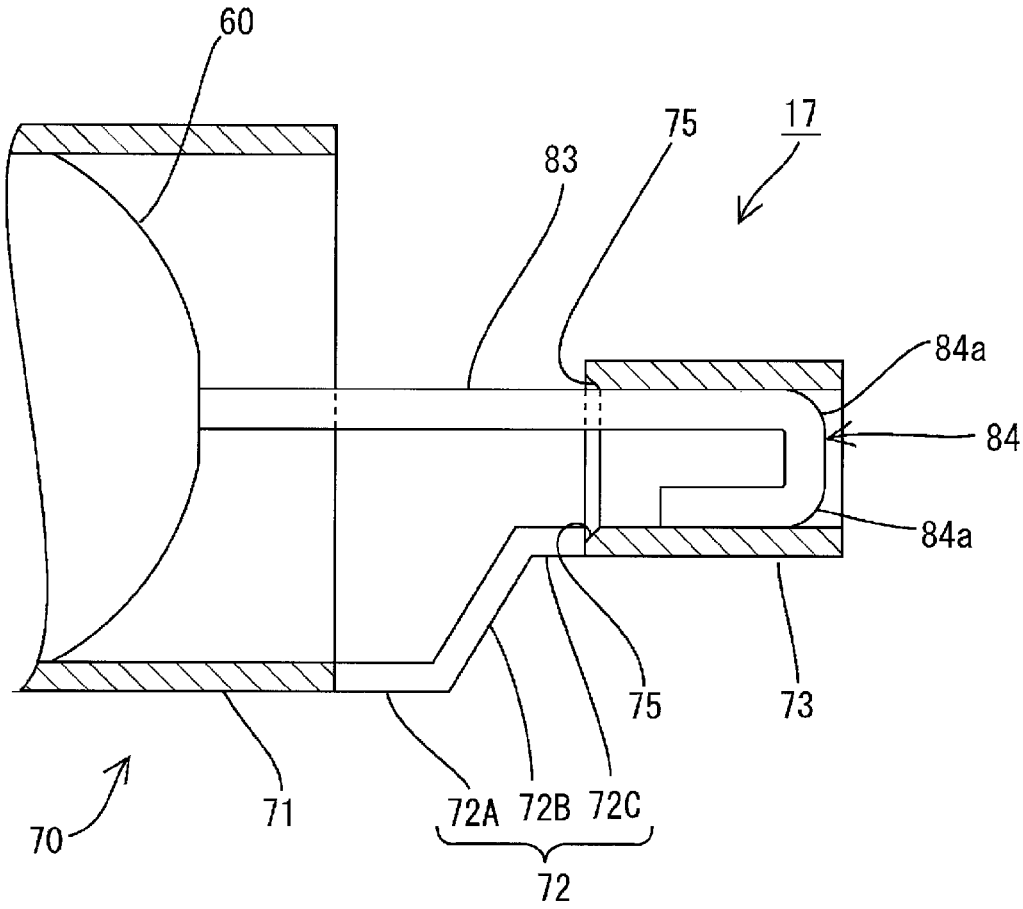

[FIG.] 2 is an exploded perspective view illustrating a general construction of a liquid crystal display device;

[FIG. 3] is a cross-sectional view of the liquid crystal display device in FIG. 2 along the line A-A;

[FIG. 4] is a plan view of a backlight device included in the liquid crystal display device in FIG. 2;

[FIG. 5] is a perspective view illustrating a general construction of relay connectors included in the backlight device in FIG. 4;

[FIG. 6] is an enlarged partial view illustrating a connection structure of the relay connector and a cold cathode tube;

[FIG. 7] is a side view illustrating a general construction of the relay connector;

[FIG. 8] is a cross-sectional view illustrating a connection structure of the relay connector and an inverter board;

[FIG. 9] is a perspective view illustrating a general construction of the cold cathode tube included in the backlight device in FIG. 4;

[FIG. 10] is an enlarged cross-sectional view of a main part of the cold cathode tube in FIG. 9;

[FIG. 11] is a front view illustrating a positional relationship between the ferrule and the outer lead of the cold cathode tube in FIG. 9;

[FIG. 12] is an explanatory view illustrating how a glass tube is inserted in the ferrule during assembly of the cold cathode tube;

[FIG. 13] is a cross-sectional view illustrating a modification of the outer lead included in the cold cathode tube;

[FIG. 14] is a cross-sectional view illustrating a modification of the outer lead included in the cold cathode tube; and

Figure 15:
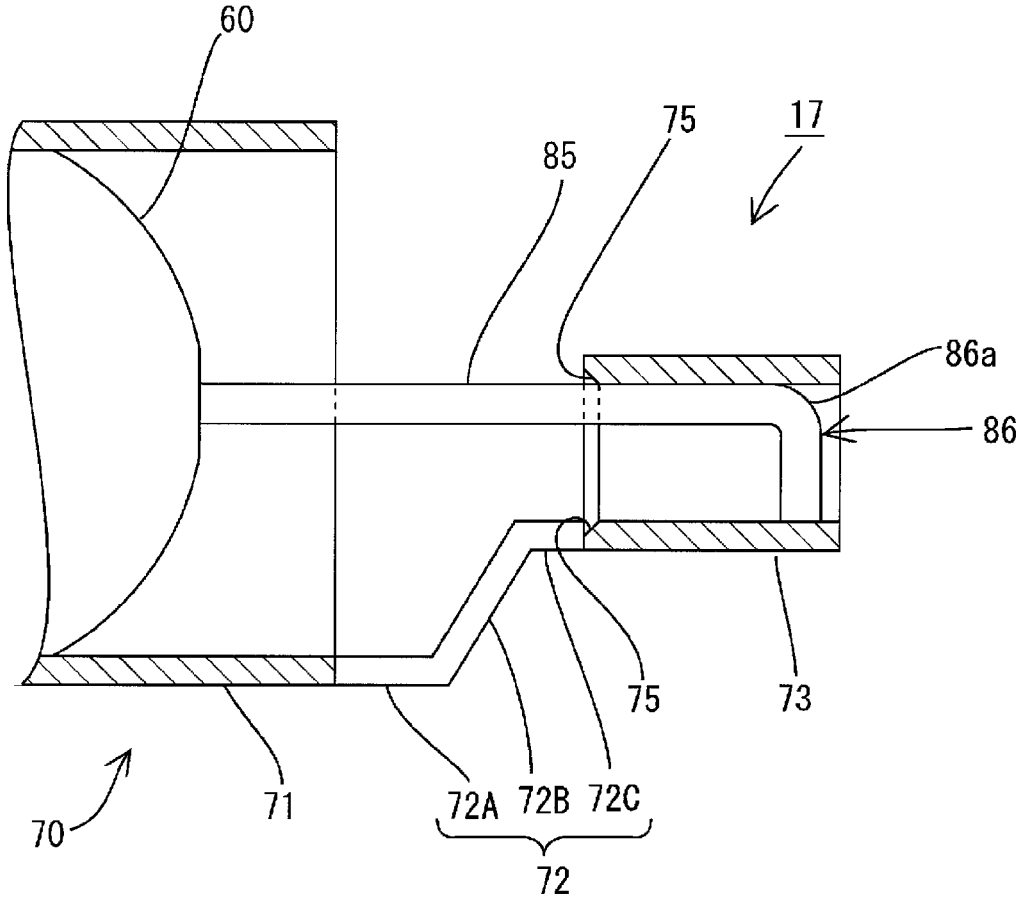

[FIG. 15] is a cross-sectional view illustrating a modification of the outer lead included in the cold cathode tube.

BEST MODE FOR CARRYING OUT THE INVENTION

An embodiment of the present invention will be explained with reference to FIGS. 1 to 12. In this embodiment, a television receiver TV including a liquid crystal display device 10 will be explained.

Figure 1:
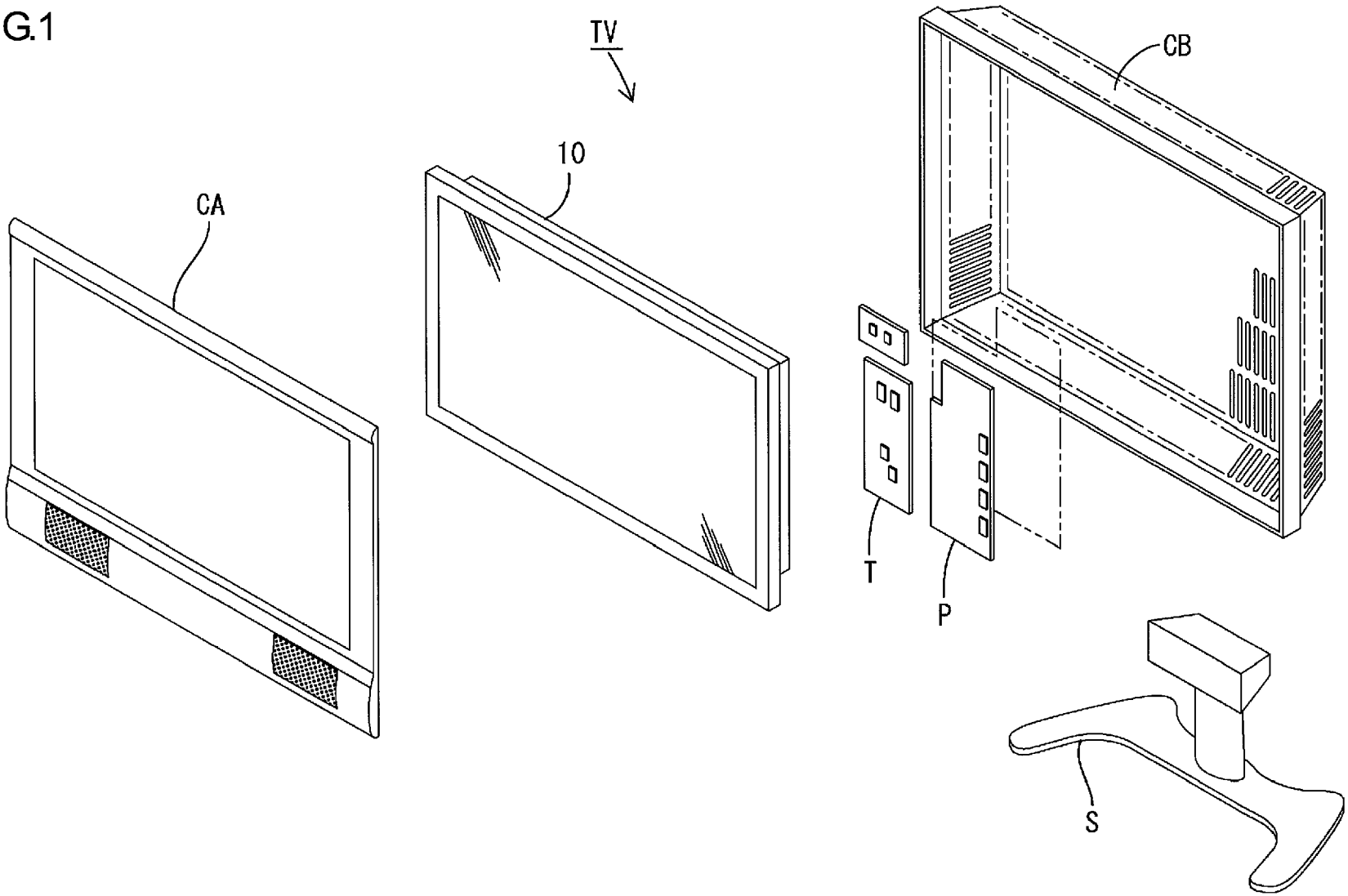
[FIG. 1] is an exploded perspective view illustrating a general construction of a television receiver according to an embodiment of the present invention.

FIG. 1 is an exploded perspective view illustrating a general construction of the television receiver of this embodiment. FIG. 2 is an exploded perspective view illustrating a general construction of the liquid crystal display device 10. FIG. 3 is a cross-sectional view of the liquid crystal display device 10 along the line A-A. FIG. 4 is a plan view illustrating a general construction of a backlight device 12 included in the liquid crystal display device 10.

As illustrated in FIG. 1, the television receiver TV of the present embodiment includes the liquid crystal display device 10, front and rear cabinets CA, CB that house the liquid crystal display device 10 therebetween, a power source P, a tuner T and a stand S. An overall shape of the liquid crystal display device (display device) 10 is a landscape rectangular. The liquid crystal display device 10 is housed in a vertical position such that a short-side direction thereof matches a vertical line. As illustrated in FIG. 2, it includes a liquid crystal panel 11 (display panel), and a backlight device 12 (lighting device), which is an external light source. They are integrally held by a bezel 13 and the like.

Next, the liquid crystal panel 11 and the backlight device 12 included in the liquid crystal display device 10 will be explained (see FIGS. 2 to 4).

The liquid crystal panel 11 is configured such that a pair of glass substrates is bonded together with a predetermined gap therebetween and liquid crystal is sealed between the glass substrates. On one of the glass substrates, switching components (e.g., TFTs) connected to source lines and gate lines that are perpendicular to each other and pixel electrodes connected to the switching components are provided. On the other substrate, counter electrodes, color filter having color sections such as R (red), G (green) and B (blue) color sections arranged in a predetermined pattern and the like are provided.

Next, the backlight device 12 will be explained. The backlight device 12 is a so-called direct backlight device in which a light source is arranged closely behind a panel surface (i.e., a display surface) of the liquid crystal panel 11. It includes a plurality of discharge tubes (cold cathode tubes 17 are used here) along the panel surface.

The backlight device 12 further includes a chassis 14, a plurality of optical members 15 (a diffuser plate, a diffusing sheet, a lens sheet and a reflection type polarizing plate, arranged in this order from the lower side of the drawings) and a frame 16. The chassis 14 has a substantially box-shape and an opening on the top. The optical members 15 are arranged so as to cover the opening of the chassis 14. The frame 16 holds the optical members 15 to the chassis 14. The cold cathode tubes 17, lamp clips 18 (not shown in FIG. 4), relay connectors (terminals) 19 and lamp holders 20 are installed in the chassis 14. The lamp clips 18 are provided for mounting the cold cathode tube 17 to the chassis 14. The relay connectors are connected to ends of the cold cathode tubes 17. The lamp holders 20 collectively cover ends of the cold cathode tubes 17 and the relay connectors 19. A light emitting side of the backlight device 12 is a side closer to the optical member 15 than the cold cathode tubes 17.

The chassis 14 is made of a metal. It is formed in a shallow box shape having a rectangular bottom plate and side walls that stand upright from the sides of the bottom plate. A light reflecting sheet 14a is disposed on a side opposite from the light emitting side of the cold cathode tubes 17 (i.e., on an inner surface of the bottom plate of the chassis 14) so as to form a light reflecting surface.

The light reflecting sheet 14a is a synthetic resin sheet having a surface in white that provides high light reflectivity. As illustrated in FIG. 4, it is placed so as to cover almost entire inner surface of the chassis 14. It is integrated with the chassis 14 so as to form a bottom surface of the chassis 14. With this light reflecting sheet 14a, light emitted from the cold cathode tubesl7 is reflected toward the optical member 15 including the diffuser plate.

Next, the relay connectors 19 will be explained with reference to FIGS. 5 to 8. The relay connectors 19 are mounted to the chassis 14 and connected to the ends of the cold cathode tubes 17.

FIG. 5 is a perspective view illustrating a general construction of the relay connectors 19. FIG. 6 is an enlarged partial view illustrating a connection structure of each relay connector 19 and the corresponding cold cathode tube 17. FIG. 7 is a side view illustrating a general construction of the relay connector 19. FIG. 8 is an explanatory view illustrating a ferrule 70 of the cold cathode tube 17 fitted in the relay connector 19.

As illustrated in FIG. 5, each relay connector 19 includes a synthetic resin holder 40 and a metal relay terminal 50 housed in the holder 40.

The holder 40 includes a box portion 41 having a block-like overall shape, and a wall portion 42 that protrudes from the back of the box portion 41 toward further back (see FIGS. 7 and 8).

The box portion 41 includes a holding area 43 that opens from the front to the side (on the side opposite from a side edge side of the chassis 14). The top opening of the holding area 43 (on the front side in FIG. 6 and the topside in FIG. 7) is a receiving opening 44 for fitting the end (ferrule 70, which will be explained later) of the cold cathode tube 17 into the holding area 43 from the top. The front opening (on the right side in FIG. 6 and the front side in FIG. 7) is an escape opening 45 configured to avoid interference to the glass tube 60 of the cold cathode tube 17 that could occur when the end of the cold cathode tube 17 is inserted in the holding area 43. A plate-like stopper 46 projects inward from the opening edge of the escape opening 45. The stopper 46 narrows the escape opening 45 makes it in a substantially U shape. A vertical size of the opening of the escape opening 45 having the substantially U shape is smaller than an inner diameter of a body 71 of the ferrule 70 and equal to or slightly larger than an outer diameter of the glass tube 60. A back end area of the edge of the escape opening 45 is formed as a concave portion 47. A curvature radius of the concave portion 47 is equal to or larger than a curvature radius of a periphery of the glass tube 60. Parts of the edge of the escape opening 45 that is located more to the front than the concave portion 47 are guide portions 48 provided as a pair.

The wall portion 42 is a plate-like member attachable in the mounting hole 14H of the chassis 14. The wall portion 42 has stopper protrusions 49 on sides (on the right and the left sides in FIG. 7). When the relay connector 19 is mounted to the chassis 14, the stopper protrusions 49 restrict the relay connector 19 from coming off of the chassis 14.

The relay terminal 50 is held in the holder 40. The relay terminal 50 is prepared by bending a metal plate punched in a predetermined shape. It includes a pair of elastic pressing pieces 51 that are curved plates and vertically symmetric to each other, a receiving portion 52 (fitting receiver portion) that connects the elastic pressing pieces 51, and a board connecting portion 53 that has a plate-like shape and projects toward the rear.

The elastic pressing pieces 51 are housed in the holding area 43 such that they are flexible in a direction that they go away from each other. The smallest distance between the elastic pressing pieces 51 in the free state when they are not elastically bent is smaller than the outer diameter of the body 71 of the ferrule 70 of the cold cathode tube 17.

The receiving portion 52 has a round C shape that opens at the top so as to allow attachment and removable of the cold cathode tube 17, and to surround a part of the periphery of the ferrule 70 when the cold cathode tube 17 is attached (see FIG. 8). On the other hand, the board connecting portion 53 projects from the back of the box portion 41 to the rear along the wall portion 42 toward the bottom of the holder 40 (toward the lower side in FIG. 7) so as to be exposed to the outside of the holder 40.

To mount the relay connector 19 to the chassis 14, as illustrated in FIG. 8, the wall portion 42 of the holder 40 is inserted from the inner side of the chassis 14 to the mounting hole 14H until the stopper protrusions 49 are engaged to the opening edge of the mounting hole 14H on the rear surface of the chassis 14. The holder 40 is mounted to the chassis 14 with displacement in the insertion direction (pass-through direction of the mounting hole 14H) restricted. When the holder 40 is mounted to the chassis 14, the wall portion 42 and the board connecting portion 53 project from the rear surface of the chassis 14.

Next, the cold cathode tubes 17 that are connected to the relay connectors 19 will be explained with reference to FIGS. 9 to 12.

FIG. 9 is a perspective view illustrating a general construction of the cold cathode tube 17. FIG. 10 is an enlarged cross-sectional view of a main part of the cold cathode tube 17. FIG. 11 is a front view illustrating a positional relationship between the ferrule and the outer lead of the cold cathode tube 17. FIG. 12 is an explanatory view illustrating how the glass tube is inserted in the ferrule during assembly of the cold cathode tube 17.

Each cold cathode tube 17 has an elongated tubular shape. A plurality of them are housed in the chassis 14 such that the longitudinal direction (i.e., the axial direction) thereof matches the longitudinal direction of the chassis 14. As illustrated in FIG. 9, it includes an elongated glass tube 60 with ends thereof are sealed, outer leads 61 and substantially cylindrical ferrules 70. Each outer lead 61 has an elongated shape with a circular cross-section. It is made of a metal such as a nickel-iron alloy, and projects from a corresponding end of the glass tube 60. The ferrules 70 are arranged around the respective ends of the glass tube 60.

Mercury is enclosed inside the glass tube 60 and a fluorescent material is applied inner surface of the glass tube 60. A part of each end of the glass tube 60 covered by the ferrule 70 is a non-light-emitting section and middle part (where the fluorescent material is applied) is a light-emitting section.

Each ferrule 70 is a single part prepared by bending or hammering a metal plate (e.g., made of stainless steel) punched in a predetermined shape. The ferrule 70 includes a body 71, a support portion 72 and an insertion portion 73. The body 71 is fitted onto the end of the glass tube 60. The support portion 72 projects from the end of the body 71 and supports the insertion portion 73, which will be explained later. The insertion portion 73 is provided at the distal end of the support portion 72. The tip of the outer lead 61 is inserted in the insertion portion 73.

The body 71 has a cylindrical overall shape with a cross section concentric circle with the glass tube 60. The inner diameter of the body 71 is slightly larger than an outer diameter of the glass tube 60. The body 71 includes three pairs of elastic holding parts 71A and 71B that are formed by cutting out parts of the body 71 so as to form slits around the elastic holding parts 71A, 71B at an equal angular interval (i.e., 120 degrees).

Each of the first elastic holding parts 71A of the pairs of elastic holding parts 71A and 71B is a cantilever part that extends generally in the axial direction (precisely, slightly bent inward in the radial direction). It is elastically flexible in the radial direction with the base end (front end) thereof as a supporting point. The distal end of the first elastic holding part 71A includes a contact portion 74A that is bent outward in the radial direction. A surface of the contact portion 74A located on the outer curved side (i.e., a surface that faces inward) is a contact point that comes into contact with the periphery of the glass tube 60. An imaginary circle that connects contact points of three first elastic holding parts 74A is a circle concentric with the body 71. The diameter of the imaginary circle is smaller than the outer diameter of the glass tube 60 when the first elastic holding parts 71A are in the free state when the first elastic holding parts 71A are not elastically bent.

Each of the second elastic holding parts 71B of the pairs of elastic holding parts 71A and 71B is provided adjacent to the first holding part 71A in the circumferential direction. An overall structure thereof is a cantilever piece that extends generally in the opposite direction to the first elastic part 71A (precisely, slightly bent inward in the radial direction). It is elastically flexible in the radial direction with base end thereof as a supporting point. The distal end of the second elastic holding part 71B is a contact point that comes into contact with the periphery of the glass tube 60. An imaginary circle that connects contact points of three second elastic holding parts 71B is a circle concentric with the body 71. The diameter of the imaginary circle is smaller than the outer diameter of the glass tube 60 when the second elastic holding part 71B is in the free state when the second elastic holding part 71B are not elastically bent.

As illustrated in FIGS. 10 and 11, the support portion 72 that extends from the end of the body 71 includes a base end section 72A, a middle section 72B and a top section 72C. The base end section 72A extends from the body 71 on the same plane with respect to the body 71 and parallel to the axis of the body 71. The meddle section 72B extends from the distal end of the base end section 72A inward in the radial direction toward the axis of the body 71. The top end section 72C extends from the distal end of the middle section 72B parallel to the axis of the body 71. The insertion portion 73 continues from the distal end of the top end section 72C. A width of the support portion 72 is sufficiently smaller than a length thereof. Therefore, the support portion 72 is elastically flexible in the radial direction of the body 71 or in a direction that crosses the radial direction (a direction that crosses a length direction of the support portion 72), or elastically twisted around itself as a torsion axis.

The insertion portion 73 is prepared by forming apiece extends from the distal end of the support portion 72 and jetties in the horizontal direction into a drum-like shape. It is positioned such that the axis thereof substantially matches the axis of the body 71. The insertion portion 73 has a guide section 75 on the body 71 side (from which the outer lead 61 is inserted). The tapered guide section 75 is formed such that the peripheral edge of the insertion portion 73 is tapered inward. The insertion portion 73 can change a position thereof around the axis or in the radial direction of the ferrule 70 according to the elastic deflection of the support portion 72.

A loop portion 62 at the tip of the outer lead 61 is inserted into the insertion portion 73. In this embodiment, as illustrated in FIG. 10, the loop portion 62 is formed in a substantially U shape and has a top section 63 at which the outer lead 61 is gently bent and straight sections thereof extend substantially parallel to each other. The loop portion 62 is elastically flexible so as to bend in the radial direction of the insertion portion 73 with the top section 63 as a center point or in the direction that crosses the radial direction (i.e., the direction that crosses the axial direction of the outer lead 61) . The width of the loop portion 62 (the width between the straight sections of the outer lead 61, that is, the vertical distance between them in FIG. 10) is equal to or slightly larger than the inner diameter of the insertion portion 73. As a result, the loop portion 62 of the outer lead 61 is inserted into the insertion portion 73 with elastic deformation and in contact with the inner surface of the insertion portion 73.

Next, a process of attaching the ferrules 70 to the glass tubes 60 will be explained.

In the process, each glass tube 60 and the ferrules 70 are held by respective holding devices (not shown) and they are brought closely to each other with the axes thereof aligned. Then, the bodies 71 are fitted onto the respective ends of the glass tube 60. As the glass tube 60 goes into the bodies 71, the contact points 74A, 74B at the distal ends of three pairs of the elastic holding parts 71A, 71B are elastically brought into contact with the periphery of the glass tube 60. As the glass tube 60 goes further into the bodies 71, the elastic holding parts 74A, 74B rub against the peripheral surface of the glass tube 60 at the contact points 74A, 74B.

As the glass tube goes still further into the bodies 71, the tips of the outer leads 61 (the loop portions 62) pass through the bodies 71 and start entering inner space of the insertion portions 73.

In this process, the central axes of the loop portions 62 and those of the insertion portions 73 maybe misaligned due to differences in sizes of the holding devices. In such a case, the loop portions 62 are more likely to touch the edges of the insertion portions 73 as illustrated in FIG. 12. With the guide sections 75, the curved surfaces of the loop portions 62 slide along the guide sections 75 and forces that guide the loop portions 62 into the inner space of the insertion portions 73 are applied. Further, the outer leads 61 are elastically flexible and the insertion portions 73 are flexible so as to change positions thereof. Therefore, the misalignment between the loop portions 62 and the insertion portions 73 can be compensated. Namely, even when the misalignment between the loop portions 62 and the insertion portions 73 occurs, they are aligned at proper positions such that the axes thereof match as the glass tube 60 further enters the ferrules 70. As a result, the loop portions 62 are smoothly inserted into the insertion portions 73. The loop portions 62 are positioned within the insertion portions 73, or such that they slightly project from the edges of the insertion portions 73 located on the ends opposite from the ends from which the loop portions 62 are inserted, or the tops thereof are substantially aligned with the edges without projecting largely from the edges.

After the above process, the following process may be performed as necessary.

The insertion portions 73 are swaged such that they are deformed to shrink in the radial direction. The swaged insertion portions 73 and the outer leads 61 are fixed together by welding so as to be electrically conductive, and the ferrules 70 and the glass tube 60 are integrated. Then, the assembly is completed and the cold cathode tube 17 is prepared. In this embodiment, the loop portions 62 are elastically in contact with the inner surfaces of the insertion portions 73 and held by the insertion portions 73 with significant holding forces. Therefore, the welding may not be necessary.

The cold cathode tube 17 prepared by the above process is attached to the relay connectors 19 (see FIG. 8). To attach the cold cathode tube 17 to the relay connectors 19, the cold cathode tube 17 is held in the horizontal position and brought closer to the bottom of the chassis 14. Then, the ends of the glass tube 60 and the ferrules 70 are fitted into the holding areas 43 of the relay connectors 19. At this time, the bodies 71 of the ferrules 70 push the elastic pressing pieces 51 so as to open them in the horizontal direction. After they have passed through the smallest gap between the elastic pressing pieces 51, the elastic pressing pieces 51 draw the bodies 71 into the holding areas 43 further back with elastic restoring forces thereof, and the bodies 71 come in contact with the receiving portions 52. Then, the attachment of the cold cathode tube 17 to the relay connectors 19 is complete.

When the attachment is complete, the outer leads 61 are electrically connected with the relay terminals 50 (the receiving portions 52) via the ferrules 70. Further, the glass tube 60 is held while being pressed against the stoppers 46 around a void section 47. When vied in the axial direction of the cold cathode tube 17, a part of the body 71 look overlaps the stopper 46.

The attached cold cathode tube 17 is held by the elastic pressing pieces 51 at the ends thereof, and mounted to the chassis via the relay terminals 50 and the holders 40 that are the mounting bodies of the relay terminals 50.

The inverter boards (external power sources) 30 are mounted on the chassis 14 on a side opposite from the side on which the cold cathode tubes 17 (i.e., on the outer surface of the bottom plate of the chassis, on the back of the chassis 14) are arranged (see FIG. 2). Each inverter board 30 includes electrical components (not shown) including a transformer for generating a high frequency voltage to turn on the cold cathode tubes 17. Power is supplied to the cold cathode tube 17 from the terminal receiving section 31 connected to the electrical components to the cold cathode tube 17.

To mount the inverter board 30 to the chassis 14, the wall portion 42 and the board connecting portion 53 that project from the back surface of the chassis 14 are inserted in the terminal receiving section 31. The board connecting portion 53 is provided along the wall portion 42. When they are inserted, the power supply from the inverter board 30 to the relay connector 19 becomes available.

The cold cathode tubes 17, the backlight device 12 including the cold cathode tubes 17, the liquid crystal display device 10 including the backlight device 12 and the television receiver TV including the liquid crystal display device 10 provide the following operational effects.

Each cold cathode tube 17 according to the present embodiment has a configuration in which the tip of the outer lead 61 that projects from each end of the glass tube 60 includes the loop portion 62, and the outer lead 61 is electrically connected to the ferrule 70 when the loop portion 62 is inserted in the insertion portion 73 of the ferrule 70.

By preparing the loop portion 62 at the tip of the outer lead 61, the apparent width of the tip becomes larger in comparison to a straight tip and thus the apparent strength of the tip is enhanced. With this structure, even when the tip of the outer lead 61 hits the edge of the insertion portion 73 on the end thereof from which the outer lead 61 is inserted, the outer lead 61 is less likely to be unexpectedly deformed or damaged. As a result, the outer lead 61 is properly connected to the ferrule 70 having the insertion portion 73 without decreasing the yield rate.

In this embodiment, the loop portion 62 has the top section 63, the outer rim of which is curved.

With this configuration, the outer lead 61 is smoothly inserted into the insertion portion 73 even when the loop portion 62 hits the edge of the insertion portion 73 because the top section 63 functions as an insertion guide.

Especially in this embodiment, the loop portion 62 is elastically in contact with the inner surface of the insertion portion 73.

With this configuration, the loop portion 62 is inserted in the insertion portion 73 with elastic deformation, and thus the loop portion 62 is held in by the insertion portion 73 with a sufficient holding force produced by the elastic restoring force of the loop portion 62. As a result, the welding of the outer lead 61 and the insertion portion 73 may not be necessary during the attachment work of the ferrule 70 to the glass tube 60, which is usually required. Therefore, the work efficiency improves.

In this embodiment, the tapered guide portion 75 is provided at the edge of the insertion portion 73 on the end from which the outer lead 61 is inserted.

With this configuration, the curved surface of the loop portion 62 slides along the guide section 75 and the outer lead 61 is guided into the inner space of the insertion portions 73. As a result, an external force applied to the outer lead 61 is reduced and the outer lead 61 is less likely to be deformed.

In this embodiment, the chassis 14 on which the cold cathode tube 17 is mounted includes relay connectors 19 electrically connected to the inverter board 30. The ferrules 70 of the cold cathode tube 17 are fitted in the receiving portions 52 of the relay connectors 19 connected to the inverter boards 30. Thus, harnesses usually used to connect the cold cathode tube 17 to the inverter board 30 are not required. Namely, problems related to broken harnesses will not occur and thus electrical connection between the cold cathode tube 17 and the inverter boards 30 is properly made. Further, the fitting of the ferrules 70 in the receiving portions 52 also completes the mounting of the cold cathode tube 17 to the chassis 14 and thus efficiency in the assembly work improves.

Especially in this embodiment, each receiving portion 52 has a C shape and surrounds a part of the periphery of the body 71 of the ferrule 70.

With this configuration, the outer lead 61 of the cold cathode tube 17 is electrically connected to the relay connector 19 with a simple work, which is the fitting of the ferrule of the cold cathode tube 17 into the receiving portion 52 having a C shape. Therefore, time required for connecting them can be reduced.

The present invention is not limited to the above embodiments explained in the above description. The following embodiments may be included in the technical scope of the present invention, for example.

(1) In the above embodiment, the outer lead 61 having the substantially U-shaped loop portion 62 is used. However, the tip of the outer lead 61 is not limited to such a shape, and outer leads having the following shapes of tips can be used. For example, an outer lead 80 illustrated in FIG. 13 has a substantially V-shaped turn portion 82. An end of the outer lead 80 is sharply bent at a turning point 82*a*. An outer lead 83 illustrated in FIG. 14 has a substantially square U-shaped turn portion 84. An end of the outer lead 83 is bent at a substantially right angle at turning points 84*a*, 84*b*. Alternatively, an outer lead 85 illustrated in FIG. 15 can be used. An end of the outer lead 85 is bent at a substantially right angle at one turning point 86*a* and thus has a substantially L shape.

(2) In the above embodiment, the outer lead 61 projects concentrically with the glass tube 60. However, it is not limited to such a configuration. It may project off the axial line of the glass tube 60 in the radial direction. Further, the outer lead 61 that projects straight from the glass tube 60 is not necessary to be parallel to the axis of the glass tube. It may be tilted with respect to the axis of the glass tube 60.

(3) In the above embodiment, the outer lead 61 is made of a nickel-iron alloy. However, it may be made of a metal containing cobalt or other kinds of metals.

(4) In the above embodiment, the insertion portion 73 of the ferrule 70 is formed in a cylindrical shape. However, it maybe formed in a shape having a square cross section, a triangular cross section or other shapes of cross sections.

(5) In the above embodiment, the ferrule 70 is made of a stainless steel. However, it maybe made of a different kind of metal, conductive resin or conductive rubber.

(6) In the above embodiment, three pairs of the elastic holding parts 71A, 71B are provided in the circumferential direction of the body 71 of the ferrule 70. Hover, only pair of them or a plurality of them may be provided. Further, the forms of them are not limited to the cantilevers that extend to the front or the rear. Both ends of them may be supported by the body.

(7) In the above embodiment, each relay terminal 50 includes a pair of the elastic pressing pieces 51. However, it may include only one elastic pressing piece. In this case, the elastic pressing piece should be disposed so as to face the receiving portion 52 with the cold cathode tube 17 therebetween.

(8) In the above embodiment, the cold cathode tubes 17 are used as light sources. However, other types of light sources including hot cathode tubes, xenon tubes and fluorescent tubes can be used.

(9) In the above embodiment, the TFTs are used as switching components of the liquid crystal display device 10. However, the present invention can be applied to liquid crystal devices that use switching components other than the TFTs (e.g., thin film diodes (TFDs)). It also can be applied to a black and white liquid crystal display device other than the color liquid crystal display device.

(10) In the above embodiment, the liquid crystal display device 10 using the liquid crystal panel 11 as a display panel. However, the present invention can be applied to display devices using different types of display panels.

The invention claimed is:

1. A discharge tube comprising:

a glass tube; and a ferrule disposed around an end area of said glass tube, wherein:

said glass tube includes an outer lead projecting from an end thereof and configured to receive power from an external power supply;

said ferrule includes a body configured to be fitted onto said glass tube and an insertion portion into which said outer lead is inserted; and said outer lead includes a turn portion at a tip thereof and is electrically connected to said ferrule through said turn portion inserted in said insertion portion.

2. The discharge tube according to claim 1, wherein said turn portion includes a top section, an outer rim thereof is curved.

3. The discharge tube according to claim 1, wherein said turn portion is elastically in contact with an inner surface of said insertion portion.

4. The discharge tube according to claim 1, wherein the turn portion has a substantially U shape and straight section thereof are substantially parallel to each other.

5. The discharge tube according to claim 1, wherein said turn portion has a substantially V shape having a bend point at which said outer lead bends sharply.

6. The discharge tube according to claim 1, wherein said turn portion has a substantially square U shape having two bend points at which said outer lead bends at a substantially right angle.

7. The discharge tube according to claim 1, wherein said turn portion has a substantially L shape having a single bend point at which said outer lead bends at a substantially right angle.

8. The discharge tube according to claim 1, wherein said insertion portion has a tapered edge at an end from which said outer lead is inserted.

9. A lighting device comprising:

the discharge tube of claim 1;

an external power source configured to supply power to said discharge tube; and a chassis configured as a mounting body of said discharge tube and said external power source.

10. The lighting device according to claim 9, wherein:

said chassis includes a terminal electrically connected to said external power source;

sad terminal includes a receiving portion configured to receive said ferrule of said discharge tube; and said discharge tube is mounted to said chassis and power supply to said discharge tube becomes available when said ferrule of said discharge tube is fitted in said receiving portion.

11. The lighting device according to claim 10, wherein said receiving portion has a C shape and surrounds a part of a periphery of said ferrule.

12. A display device comprising:

the lighting device according to claim 9; and a display panel configured to provide display using light from said lighting device for a display device.

13. The display device according to claim 12, wherein the said display panel is a liquid crystal display panel using liquid crystal.

14. A television receiver comprising the display device according to claim 12.

* * * * *